United States Patent [19]

Dumais et al.

[11] Patent Number: 4,828,098

[45] Date of Patent: May 9, 1989

[54] COIN OPERATED LOCK FOR SKI RACK

[76] Inventors: Marcel L. Dumais, 2798, Principale, Mascouche, Quebec, Canada, J7K 3C3; Gaétan R. Dumais, 1139, Lafleur, Mascouche, Quebec, Canada, J7L 1R5

[21] Appl. No.: 150,749

[22] Filed: Feb. 1, 1988

[51] Int. Cl.[4] ..... G07F 5/04

[52] U.S. Cl. ..... 194/235; 194/253

[58] Field of Search ..... 194/253, 235

[56] References Cited

U.S. PATENT DOCUMENTS

| | | | |
|---|---|---|---|
| 888,828 | 5/1908 | Lippert | 194/253 |
| 1,586,344 | 5/1926 | Wiley | 194/253 X |

FOREIGN PATENT DOCUMENTS

| | | | |
|---|---|---|---|
| 167896 | 2/1916 | Canada . | |
| 1184885 | 4/1985 | Canada . | |
| 428161 | 5/1935 | United Kingdom | 194/253 |
| 1603206 | 11/1981 | United Kingdom | 194/253 |

*Primary Examiner*—F. J. Bartuska

*Attorney, Agent, or Firm*—Roland L. Morneau

[57] ABSTRACT

A coin operated lock for ski racks comprises a latch secured to an inner sliding member provided with a passageway for receiving a coin. The passageway has an opened bottom obstructed by a tiltable cam plate which hinder the movement of the sliding member. The introduction of a coin in the passageway tilts the cam plate and releases the sliding member. A key operated lever actuates the liberated sliding member and projects the latch outside the lock for engaging into a catch.

8 Claims, 2 Drawing Sheets

COIN OPERATED LOCK FOR SKI RACK

BACKGROUND OF THE INVENTION

Field of the invention

This invention relates to a lock which can be operated with a key and a coin and in particular to a lock which is simple and rugged so as not to be affected by cold and frost. Such lock is of particular interest for protecting skis against theft in ski racks.

Prior art

Safety devices for locking articles have usually intricate mechanisms which may be susceptible to cold and frost. Some have numerous parts which coacts through numerous movements such as in Canadian Patent No. 167,896.

The following patents were found in a patent search but were not retained as being pertinent:

U.S. Pat. Nos. 2,963,165, 3,133,619, 3,301,369, 3,722,652, and Canadian Patent No. 1,184,885.

SUMMARY OF THE INVENTION

In the present invention, the coin operated lock has no long channel thro8ugh which the coin must go through and in which frost can hinder the passage of coins. The coin is introduced in a slot and through a sliding member having a passageway.

The dimension of the coin actuates a lever which frees the sliding member until, the coin located in the passageway, drops out of it. The member is slidden by a key operated lever and actuates a latching tongue which slides into a catch to lock a door.

DETAILED DESCRIPTION OF THE INVENTION

Figure 1:
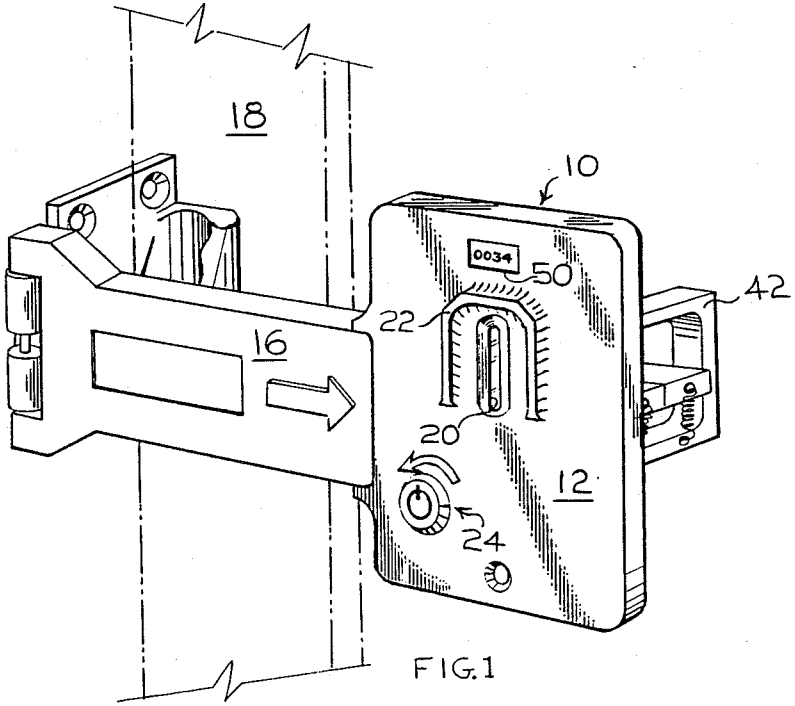
FIG. 1 is a front perspective view of the lock according to the invention in combination with a hinged door for trapping skis.
Figure 2:
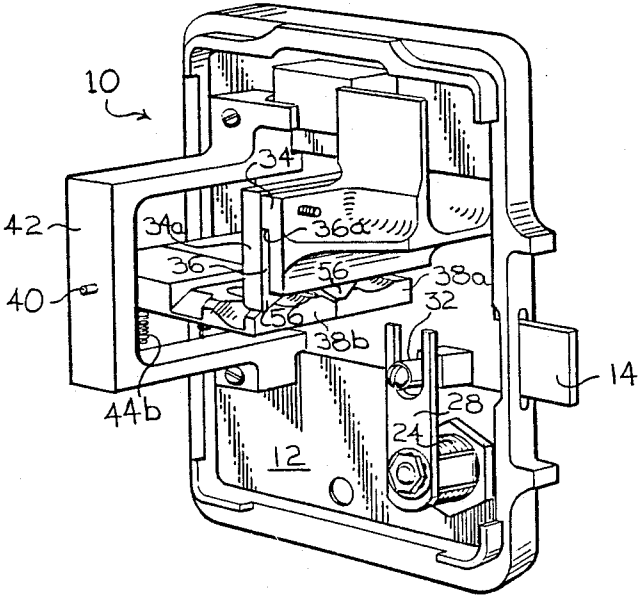
FIG. 2 is a rear perspective view of the lock shown in FIG. 1, FIGS. 3 and 4 are rear plan views of the lock in two different operating position.

The face plate 12 of the lock 10 according to the invention is intented to project a latch 14 into a hinged door 16 to form a wall for enclosing, with other surrounding partitions, a pair of ski 18.

The face plate 12 is provided with a slot 20 therethrough which is partly surrounded by a protuberant surface 22 for sheltering the slot 20 against the snow. A key operated cylinder lock 24 projects on the front surface of the face plate 12 for actuating the latch 14.

Figure 3:
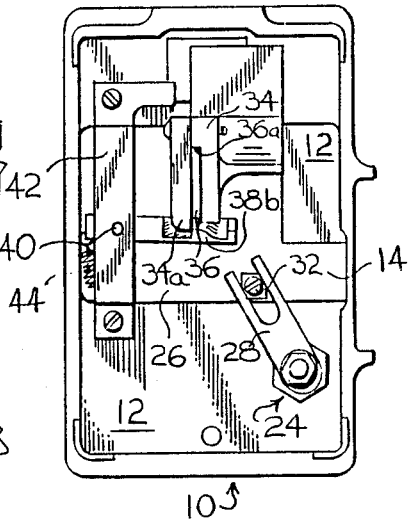

The latch 14 forms part of a back plate 26 which is adapted to slide against the internal surface of the face plate 12. The sliding action is produced by the lever 28 which is rotated by the cylinder lock 24 operated by the key 30. The top end of the lever 28 has a U-shape which engages a prong 32 secured to the back plate 26. A transversal member 34 which is provided with a passageway 36 is also secured to the back plate 26 and moves with it. In FIG. 3, the passageway 36 is aligned with the slot 20 of the front plate 12. When a coin, such as a quarter, is introduced in both the slot 20 and the passageway 36, it is supported by a cam plate **38*a* to prevent it from falling. In the embodiment illustrated, two cam plates 38*a* and 38*b* are shown although only one can be used for the purpose of the present invention. The initial part of the present disclosure will make reference to cam plate 38*a* only i.e. the one adjacent slot 20. The cam plate 38*a* is supported on an axle 40 mounted on a U-shaped bracket 42 transversally secured to the face plate 12. The axle 40 is located off center on the cam plate 38*a* so as to normally clear the bottom of the transversal member 34 but the cam plate is resiliently bias upwardly by a spring 44*a* held to the bracket 42**.

Figure 4:
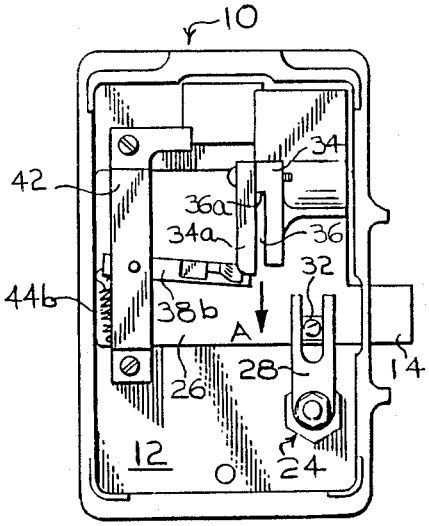

The diameter of the quarter which is introduced in the passageway 36 is of such a dimension relative to the height of the passageway, so as to tilt downwardly the cam plate **38*a* as shown in FIG. 4. The shape of the surface of the cam plate is such as to prevent the sliding of the transversal member 34 in the absence of a coin in the passageway 36. However, the presence of the coin in the passageway 36 which tilts the cam plate 38*a* allows the transversal member 34 to slide when actuated by the cylinder lock 24. When the member 34 has reached the end of its course, the coin will drop out of the passageway 36 as shown by arrow A in FIG. 4**.

A pair of adjacent cam plates **38*a* and 38*b* and springs 44*a* and 44*b*** are used when the amount charged corresponds to two coins. The operation of the second one will be explained latter.

The coin operated lock is installed on a ski rack usually around a ski resort or at the bottom of ski slopes. The door 16 is left opened relative to the lock 10, the latch 14 is retracted inside the lock 10 and the key 30 inserted in the cylinder lock 24 is in a position in which it cannot be removed. A skier who wants to safeguard his skis and poles while he leaves them unattended puts them behind the door 16 and closes the latter to face the lock 10. A coin is introduced in the slot 20 and pushed till it reaches the passageway 36. The coin tilts the cam plate **38*a* which unlocks the transversal member 34. The back plate 26 becomes free to slide. The rotation of the key 30 rotates the lever 28 which slides out the latch 14. The latch 14 penetrates into the door 16 and prevents it from opening. In that position, the key is removed from the cylinder lock 24 and kept by the owner of the skis. Upon returning, to pick up the skis, the key is introduced in the lock 24 and is rotated to retract the latch 14. In that position, the key remains locked inside the cylinder lock 24**.

Figure 6:
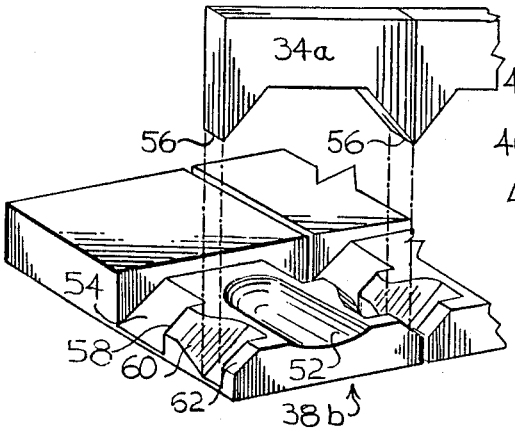
FIG. 6 is a perspective view of the cam plate for supporting the coins.
Figure 5:
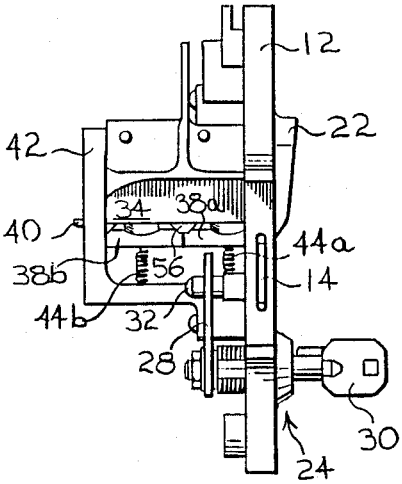
FIG. 5 is a side plan view of the lock.

A preferred shape of the cam plate **38*b* is illustrated in FIG. 6 with the rear plate 34*a* of the transversal member 34 shown higher than its normal operating position shown in FIGS. 3–5. The central portion of the top surface of the cam plate 38*b* has a cylindrical recess 52 which slopes forwardly. The cylindrical recess 52 supports the coin, maintains it in the same axial direction when the transversal member 34 moves and allows it to slide out when the passageway 36 has reached the position shown in FIG. 4**.

On each side of the cam **38*b*, there is a laterally sloping surface 54 forming a recess for receiving the teeth 56 of the rear plate 34*a*. When the teeth 56 are supported by the surfaces 54, the transversal member cannot move because it abuts against the wall 58 of the recessed surface 54. When the coin is inserted in the passageway 36 and is supported by the recess 52, the top of the coin abut against the roof 36*a* of the passageway 36 and its diameter causes the cam 38*b* to tilt downwardly. The amount of tilting is sufficient to release the teeth 56 from the wall 58 and to allow the transversal member 34 to slide towards the end of the cam plate 38***b* ltill the coin is released out of the passageway 36.

The cam plate 38*b* preferably comprises a second set of laterally sloping surfaces 60 and a second set of abuting walls 62 for catching the teeth 56 if there is no coin on the recess 52. This situation may happen if someone tampers with the lock by inserting a thin blade in the slot 20 and applying a downward pressure on the cam 38*b*. This tampering action will initiate the movement of the transversal member 34 but by the time the slot 20 will be fully closed by the back plate 26 and the thin blade retracted, the teeth 56 will abut against the walls 62 and the corresponding rotation of the key 30 will not proceed further. At that stage, the key 30 cannot be removed from the cylindrical lock 24. The second sloping surfaces 60 constitute a protection against unpaid use of the device.

As it is particularly shown in FIG. 5, more than one cam plate is used when the cost of using the device is established at more than one coin, that is, two quarters or three quarters. FIG. 5 shows two cam plates 38*a* and 38*b* independently mounted side by side on axle 40 and resiliently biassed upwardly by springs 44*a* and 44*b*. The shape of both cam plates 38*a* and 38*b* is the same and operates in a similar manner. If only one coin is inserted, only cam plate 38*a* will be tilted and cam plate 38*b* will remain in contact with the teeth 56 above the sloping surfaces 54 of the rear plate 34*a*. In such embodiment, the transversal member 34 and its rear plate 34*a* extend across both cam plates 38*a* and 38*b* and are provided with teeth 56 above the sloping surfaces 54. It should be obvious that more than two cam plates may be used without departing from the structure described above.

A window 50 displays a counter which identifies the number of back and forth movements of the back plate 26 and accordingly the number of coins which should be collected.

We claim:

1. A coin operated lock comprising a face plate having a slot therethrough for receiving a coin, a back plate slidingly mounted behind said face plate on a predetermined pathway length, the said back plate having a transversal member extending away from said face plate and adapted to slide across said slot, said transversal member having a passageway for receiving said coin from said slot, said passageway being opened along its lower face, a cam plate mounted on said face plate below said transversal member for obstructing said lower face of the passageway along a portion of said pathway, the said cam plate being tiltingly mounted and resiliently biassing in the direction of the transversal member, said cam plate having a protuberance for inhibiting the sliding of said transversal member relative to said cam plate, the height of the passageway being slightly smaller than the height of the coin, to allow the coin when in said passageway to tiltingly depress said cam plate for allowing sliding freedom to the transversal member, a key operated lever mounted on said face plate for slidingly moving said back plate and said transversal member until the lower face of said passageway is moved outside the cam plate to allow the coin to drop out of the passageway while said protuberance maintains said cam plate tiltingly depressed, the said back plate being provided with a latching tongue adapted to slide outside the face plate with the sliding of the said back plate, whereby said tongue is adapted to slide into a catch for retaining said tongue.

2. A coin operated lock as recited in claim 1, wherein the said cam plate comprises a first groove for engaging the transversal member and preventing the sliding of said member.

3. A coin operated lock as recited in claim 2, wherein the said cam plate has a second groove parallel to and adjacent the first groove for engaging the transversal member when the coin is not positively inserted in the passageway thereby preventing the back plate to reach the other end of the pathway.

4. A coin operated lock as recited in claim 1, comprising a key and a key lock mounted on said face plate for operating said key operating lever, said key lock being adapted to lock and to release the key only when the base plate has reached the end of the pathway corresponding to the position of the transversal member for dropping the coin.

5. A coin operated lock as recited in claim 1, wherein the cam plate has a trough for supporting the coin in the transversal member, the said trough extending in the direction of the sliding movement of the transversal member for guiding the coin til it drops out of the passageway.

6. A coin operated lock as recited in claim 1, wherein the said back plate has a prong, the said key operated lever being rotatably mounted for engaging said prong and for slidingly moving the latter with the back plate.

7. A coin operated lock as recited in claim 1, comprising a second transversal member secured to and adjacent said first mentioned transversal member, a second cam plate mounted adjacent and on the same plane as the first mentioned cam plate, the said second cam plate being tiltingly mounted separately from said first cam plate and resiliently biassing in the direction of the second transversal member, the said second cam plate and said second transversal member having the above-mentioned structural features corresponding to the first cam plate and first transversal member, wherein said cam plates are tiltingly depress upon insertion of two coins in said slot and passageway to allow the simultaneous sliding of the two transversal member.

8. A coin operated lock as recited in claim 1, wherein the said face plate is provided with an opening, a counter mounted in said opening, the said counter being adapted to be operated by the sliding movement of the back plate and the transversal member.

* * * * *